US007464697B2

(12) United States Patent
Gray, Jr.

(10) Patent No.: US 7,464,697 B2
(45) Date of Patent: Dec. 16, 2008

(54) HIGH-PRESSURE FUEL INTENSIFIER SYSTEM

(75) Inventor: Charles L. Gray, Jr., Pinckney, MI (US)

(73) Assignee: The United States of America, as represented by the Administrator of the U.S. Environmental Protection Agency, Washington, DC (US)

( * ) Notice: Subject to any disclaimer, the term of this patent is extended or adjusted under 35 U.S.C. 154(b) by 128 days.

(21) Appl. No.: 11/207,227

(22) Filed: Aug. 19, 2005

(65) Prior Publication Data

US 2007/0039590 A1 Feb. 22, 2007

(51) Int. Cl.
*F02M 69/46* (2006.01)
*F02M 51/00* (2006.01)

(52) U.S. Cl. ..... 123/456; 123/495; 417/225

(58) Field of Classification Search ..... 123/446, 123/456, 495, 447, 467, 468, 506; 417/225, 417/226, 227

See application file for complete search history.

(56) References Cited

U.S. PATENT DOCUMENTS 6,192,864 B1 * 2/2001 Nishimura ..... 123/458
6,463,914 B2 * 10/2002 Augustin et al. ..... 123/502
6,776,138 B2 * 8/2004 Mahr et al. ..... 123/446
6,805,101 B2 * 10/2004 Magel ..... 123/467
6,845,754 B2 1/2005 Pecheny et al. ..... 123/446
6,880,527 B2 * 4/2005 Magel ..... 123/467
6,889,659 B2 * 5/2005 Magel ..... 123/446
6,892,703 B2 * 5/2005 Magel ..... 123/446
6,910,463 B2 * 6/2005 Oshizawa et al. ..... 123/446
2002/0185112 A1 12/2002 Lei ..... 123/446
2003/0062026 A1 4/2003 Boecking ..... 123/446
2003/0089332 A1 5/2003 Yomogida ..... 123/299
2003/0111061 A1 6/2003 Coldren et al. ..... 123/514
2003/0116136 A1 6/2003 Schwarz ..... 123/447
2003/0146295 A1 8/2003 Lei ..... 239/88
2003/0213446 A1 11/2003 Tanaka et al. ..... 123/90.12
2004/0020467 A1 2/2004 Leman et al. ..... 123/467
2004/0055562 A1 3/2004 Stewart et al. ..... 123/299
2004/0103878 A1 6/2004 Satapathy et al. ..... 123/321
2004/0168673 A1 9/2004 Shinogle ..... 123/456
2005/0034709 A1 2/2005 Augustin ..... 123/446

OTHER PUBLICATIONS

"Pressure-modulated injection of an HD diesel engine," *Off-Highway Engineering*, pp. 33-43, Apr. 1996.

* cited by examiner

*Primary Examiner*—Mahmoud Gimie
(74) *Attorney, Agent, or Firm*—Seed IP Law Group PLLC

(57) ABSTRACT

A fuel injection supply system includes an intensifier cylinder having an intensifier piston configured to pressurize fuel in an intensifier chamber of the cylinder during a pressurizing stroke, and further configured to draw fuel into the intensifier chamber during a recharge stroke. A fuel rail receives pressurized fuel from the intensifier chamber, and supplies the fuel to a plurality of fuel injectors. A control unit controls switching of the intensifier piston between a pressurizing stroke and a recharge stroke, controlling recharge strokes of the piston to occur between two consecutive injection events of the plurality of fuel injectors. The common fuel rail may be hydraulically locked except during injection events of any of the plurality of fuel injectors, or during a recharge stroke of the piston. The intensifier piston may be controlled to perform a recharge stroke once during each engine cycle, or more than once during each engine cycle.

19 Claims, 4 Drawing Sheets

HIGH-PRESSURE FUEL INTENSIFIER SYSTEM

BACKGROUND OF THE INVENTION

1. Field of the Invention

The disclosed invention is related in general to the field of fuel pressurization systems for fuel injectors of internal combustion engines, and in particular to high pressure fuel intensifiers and fuel rails.

2. Description of the Related Art

In recent years, the design requirements for internal combustion engines have undergone significant changes, due to the need for improved fuel economy and reduced emissions. For example, fuel injectors employed in such engines, and in particular diesel engines, are sometimes designed to operate at pressures that are an order of magnitude greater than were common in the past. Currently, injection pressures may exceed 25,000-30,000 psi. This increased pressure provides improved injection characteristics such as fuel/air mixing in the cylinder, improved combustion temperature, and shortened injection duty cycles to allow an appropriate volume of fuel to be injected at an optimum point in the respective cylinder stroke.

According to one general method, the fuel for each injector of an engine is pressurized by a respective intensifier piston, generally incorporated into the injector, to boost the pressure of the fuel. In some cases, hydraulic fluid, pressurized to a typical hydraulic operating pressure of around 2,000 to 4,000 psi, is employed to drive the intensifier pistons, and fuel is supplied to the injectors under low pressure by a fuel pump. In other cases the fuel is pre-pressurized to a hydraulic operating pressure and employed to drive the intensifier pistons, as well. This general method is preferred by some because the fuel and hydraulic lines supplying the injectors are not required to operate at the very high injection pressures. However, there are disadvantages with this method as well. For example, the complexity of the injectors makes them more likely to malfunction, and they are expensive to repair or replace.

According to another general method, a high-pressure fuel rail is provided, from which each injector of the engine is supplied. The fuel rail is pressurized by one or more intensifier pistons driven hydraulically, or by a cam coupled mechanically to the engine. Because the rate of fuel flow in the engine is not constant, but is related to engine load and rpm, the intensifier piston must be capable of providing fuel at a rate that at least meets the maximum expected fuel demand of the engine.

Examples of some common rail fuel injection systems are disclosed in the following U.S. patents and published patent applications: U.S. Pat. Nos. 6,497,217; 6,786,205; 6,832,599; 2003/0089332; and 2004/0168673, all of which are incorporated herein by reference, in their entireties.

BRIEF SUMMARY OF THE INVENTION

According to an embodiment of the invention, a fuel injection supply system is provided, including an intensifier cylinder having an intensifier piston configured to pressurize fuel in an intensifier chamber of the cylinder during a pressurizing stroke, and further configured to draw fuel into the intensifier chamber during a recharge stroke. A fuel rail in fluid communication with the intensifier chamber receives pressurized fuel therefrom, and supplies the pressurized fuel to a plurality of fuel injectors. A control unit is configured to control switching of the intensifier piston between a pressurizing stroke and a recharge stroke of the piston, the control unit adapted to control recharge strokes of the piston to occur between two consecutive injection events of the plurality of fuel injectors.

According to an embodiment, the common fuel rail is not provided with a relief vent, such that the intensifier piston is hydraulically locked except during injection events of any of the plurality of fuel injectors, or during a recharge stroke of the piston.

The control unit may be configured to control switching of the intensifier piston to perform a recharge stroke once during each cycle of an engine associated with the fuel injection system, or more than once during each cycle of the engine.

According to another embodiment of the invention, the system includes an additional intensifier cylinder adapted to pressurize a separate common fuel rail configured to provide pressurized fuel to some of the plurality of fuel injectors.

Another embodiment provides a method of operation of a fuel injection system.

BRIEF DESCRIPTION OF THE SEVERAL VIEWS OF THE DRAWING(S)

In the drawings, identical reference numbers identify similar elements or acts. The sizes and relative positions of elements in the drawings are not necessarily drawn to scale.

DETAILED DESCRIPTION OF THE INVENTION

In the following description, certain specific details are set forth in order to provide a thorough understanding of various embodiments of the invention. In other instances, well-known structures associated with internal combustion engines and fuel injection systems have not been shown or described in detail to avoid unnecessarily obscuring descriptions of the embodiments of the invention.

Figure 1:
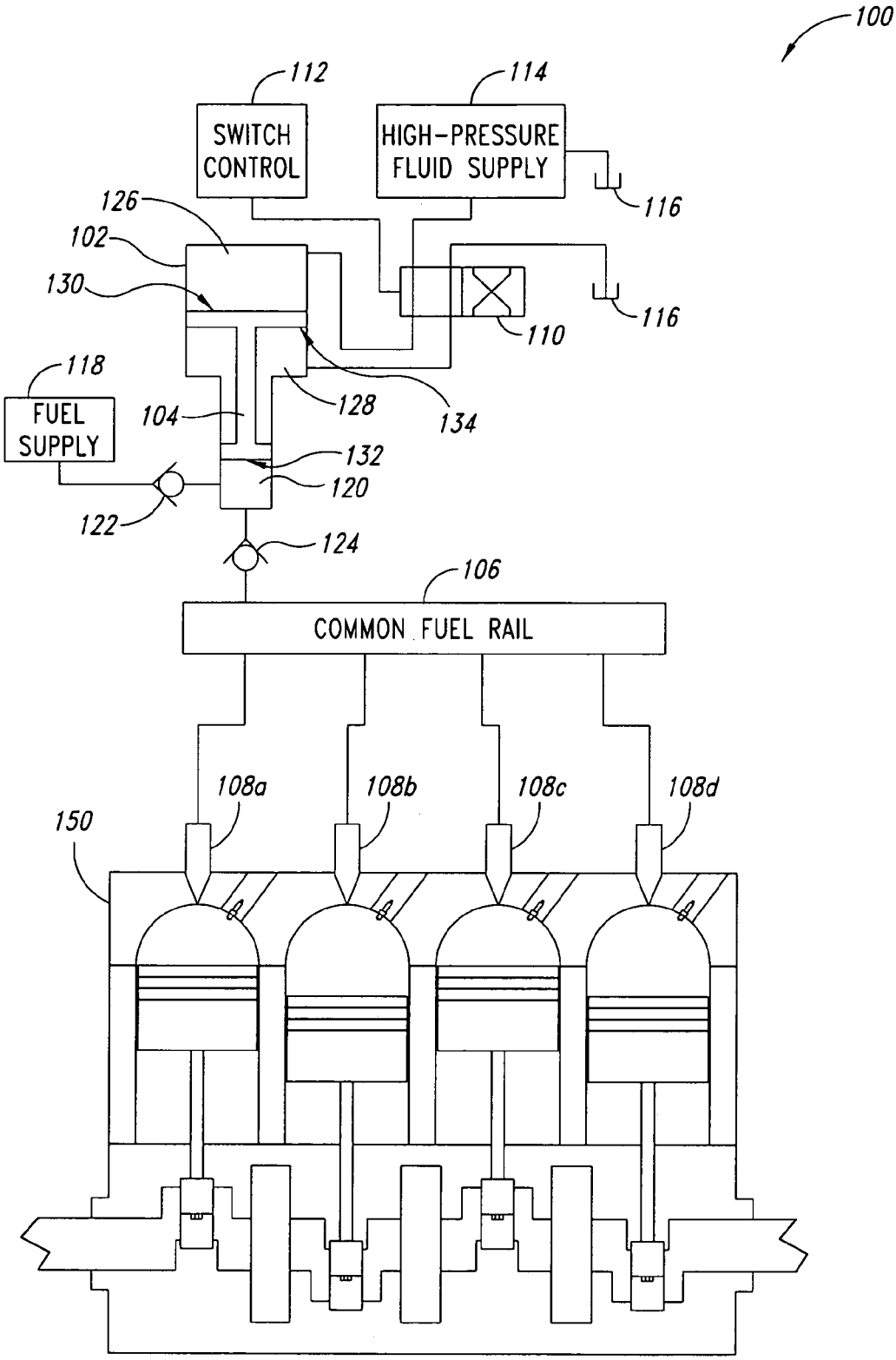
FIG. 1 shows a fuel injection system for an internal combustion engine, according to an embodiment of the invention.

FIG. 1 diagrammatically illustrates a fuel distribution system 100 for an engine 150, including an intensifier cylinder 102 and piston 104, a common fuel rail 106, and a plurality of fuel injectors 108*a*-108*d*. The piston 104 is controlled by a switching valve 110 that in turn is controlled by a switching control unit 112. Hydraulic fluid, pressurized to a typical operating pressure of, for example 2,000 psi, is provided by a high-pressure fluid supply 114 in a known manner. A fluid sump 116 receives depressurized fluid from the switching valve 110. The Hydraulic fluid may be, for example, pressurized engine oil, or another appropriate hydraulic fluid. A fuel supply 118 is coupled to an intensifier chamber 120 of the cylinder 102 via a check-valve 122. The intensifier chamber 120 is also in fluid communication with the common rail 106 via a check-valve 124. The fuel supply may include components such as a fuel reservoir, a low pressure fuel pump, and a fuel filter, such as are well known in the art. In FIG. 1, the switching valve is shown in a first position, in which fluid from the high-pressure fluid supply 114 is directed to an upper control chamber 126 of the cylinder 102 while a lower control chamber 128 of the cylinder 102 is placed in fluid communication with the sump 116. In this configuration, high-pressure fluid acting on an upper piston surface 130 drives the intensifier piston 104 downward, venting fluid in the lower control chamber 128 to the sump 116 and pressurizing fuel in the intensifier chamber 120. The pressurized fuel is then provided to the fuel rail 106 via the check-valve 124.

The pressure attained by the fuel in the intensifier chamber 120 is a function of the pressure of the high-pressure fluid supply 114 multiplied by the ratio of the surface area of the upper piston surface 130 relative to an intensifier piston surface 132, the principles of which are well known in the art.

When the switch control unit moves the switching valve 110 to its second position, the high-pressure fluid supply 114 is placed in fluid communication with the lower control chamber 128 while the upper control chamber 126 is placed in communication with the sump 116. In this configuration, high-pressure fluid acting on a lower piston surface 134 drives the intensifier piston 104 upward, venting fluid in the upper control chamber 126 to the sump 116 and drawing fuel from the fuel supply into the intensifier chamber 120. For the purposes of this disclosure, a period in which the switching valve 110 is in the second position will be referred to as a recharge period, or recharge stroke of the intensifier piston 104, during which the piston recharges the intensifier chamber 120 with fuel to be pressurized.

In contrast to many prior art systems, the common rail 106 is not provided with a relief valve set at injection pressure. Accordingly, while fuel is flowing from one of the injectors 108, fuel passes at the same rate from the intensifier chamber 120. However, during periods while no injector is firing and the switching valve is in the first position, the intensifier piston 104 is hydraulically locked, such that no fuel passes from the intensifier chamber 120 to the common rail 106.

It will be recognized that pressurizing fuel to the extremely high pressure of the injection system requires a significant amount of energy, which is drawn, ultimately, from the energy produced by the operation of the engine. In prior art systems in which the common rail includes a relief valve to vent excess pressurized fuel back to the fuel tank, the high-pressure fuel vented from the rail represents a loss of the energy invested in its pressurization. An advantage of the embodiments disclosed herein is that none of the highly pressurized fuel is vented to low pressure, thus reducing the waste of energy and thereby increasing overall efficiency of the engine.

The injectors 108*a*-108*d* fire in a prescribed sequence as the respective cylinder pistons of the associated engine reach the appropriate point in the engine cycle for fuel injection. According to well known principles of operation, each cylinder of a four-cycle engine receives fuel once every two rotations of the crankshaft. In many modern engines the injection timing is very closely controlled, and occurs during a small fraction of the rotation period of the crankshaft. Thus, even in engines equipped with sixteen or more injectors, none of the injectors are actually firing during much of the rotation period of the engine.

Figure 2:
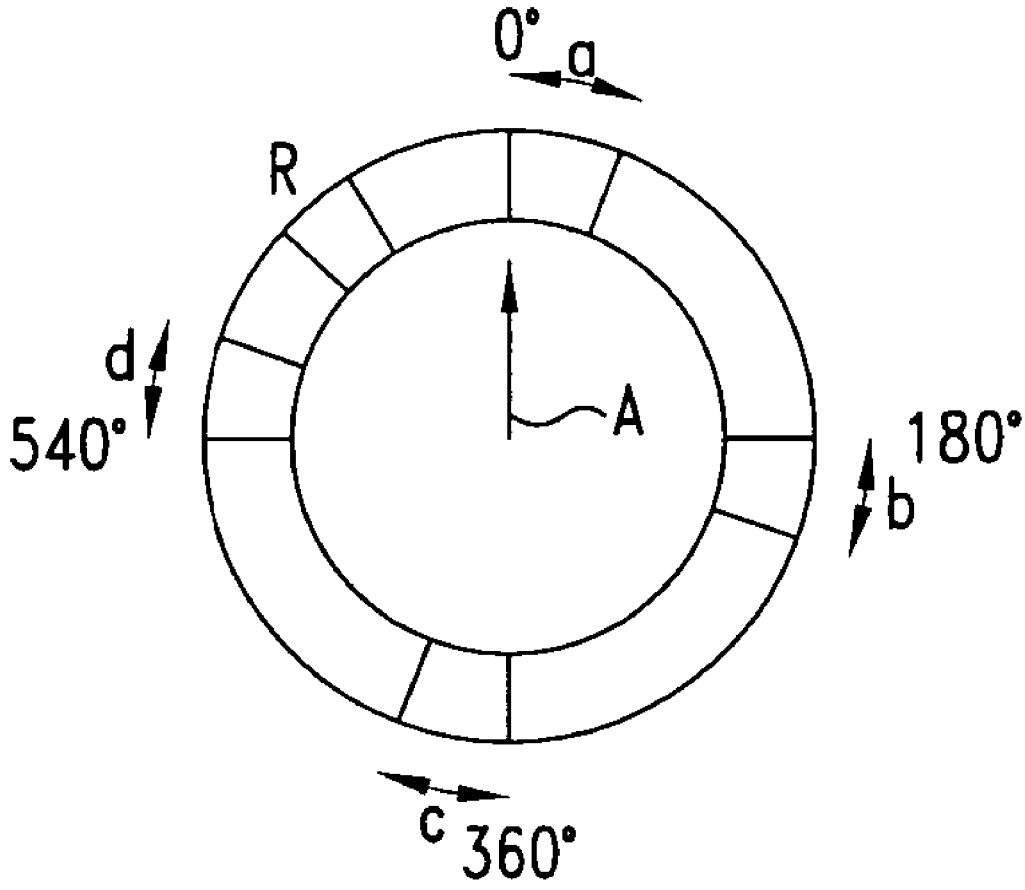
FIG. 2 shows a timing diagram illustrating the operation of the embodiment of FIG. 1.

Referring now to FIG. 2, a diagram representing a complete firing cycle of the engine, or two rotations of the crankshaft, is shown. The arrow A represents the crank position of the engine. The degree angles shown in the diagram are arbitrary, with respect to the actual crank angle of a typical engine, and are provided to show the distribution and timing of the injectors 108*a*-108*d*. Injector 108*a* opens during the period indicated by a, Injector 108*b* opens during the period indicated by b, and so on. The recharge stroke of the piston 104 is timed to occur between two of the injection periods, as shown, and does not overlap any of the injection events. In this way, the fuel pressure remains constant during all of the injection events.

As fuel flow and engine rpm increases, each injection event increases in length, and the time between injection events shortens. At the same time, the recharge stroke will also lengthen, since the volume of fuel flowing per engine cycle is increased, meaning that the piston 104 will have traveled farther during the cycle, and must travel farther to recharge. Furthermore, in engines having more than the four injectors shown in FIG. 1, the injector events will be spaced more closely together. According to an embodiment of the invention, the switching control unit 112 is configured to switch to a recharge stroke more than once during an engine cycle, thereby shortening each recharge period. The switching control unit 112 may be programmed to switch from one recharge stroke per cycle to multiple recharge strokes per cycle only above some selected threshold rpm or fuel-flow, or may recharge the intensifier chamber 120 several times per cycle under all engine operating condition.

According to another embodiment of the invention, the fuel injectors of the engine are supplied by more than one common fuel rail, such that, for example, half the injectors are supplied by the system 100 described with reference to FIG. 1, while the remaining injectors are supplied by a separate system substantially identical to the system 100.

Figure 3:
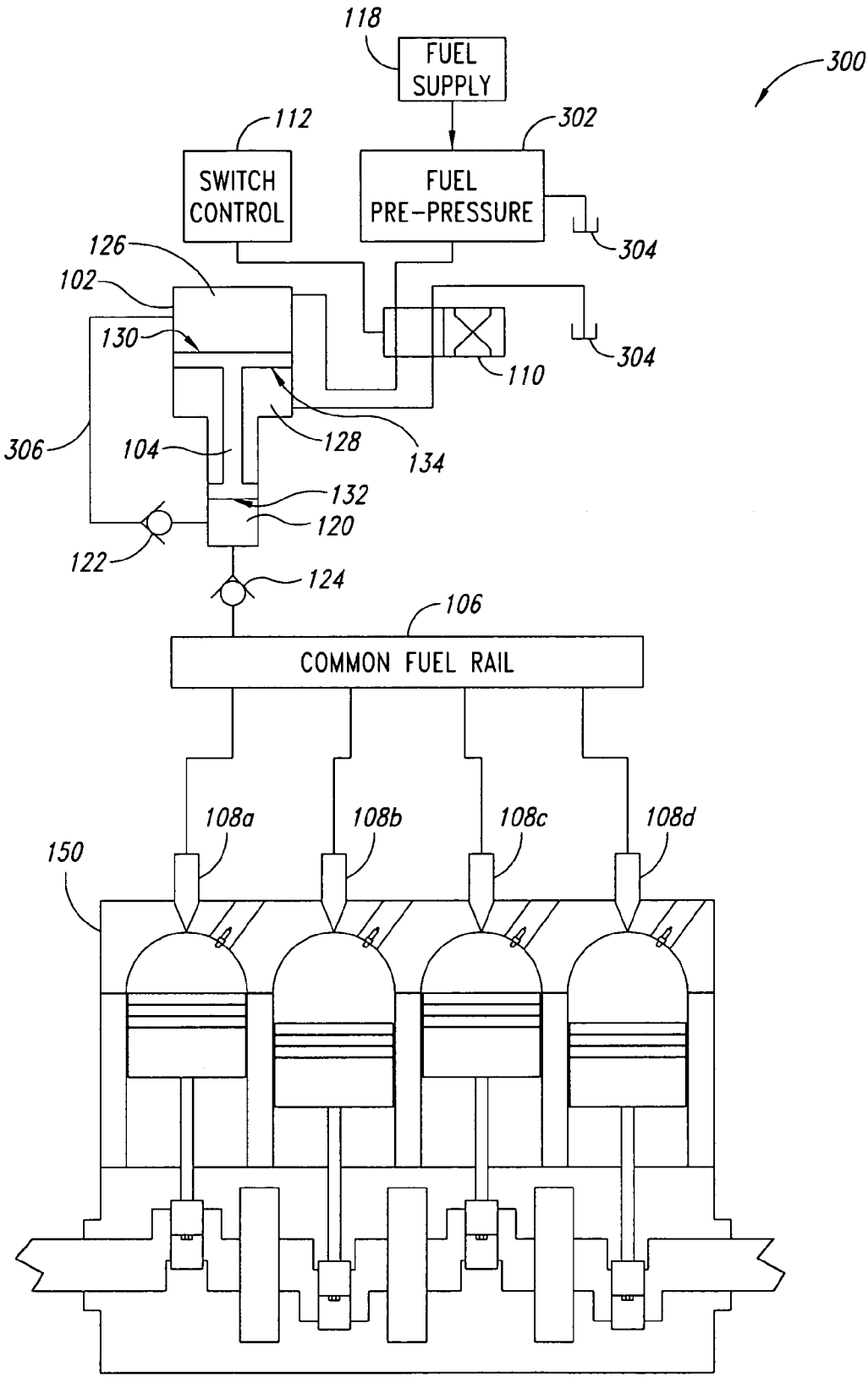
FIG. 3 shows a fuel injection system for an internal combustion engine, according to another embodiment of the invention.

Referring now to FIG. 3, another embodiment of the invention is shown, in which a system 300 is shown. Features of the system 300 that are substantially the same as those of the system 100 of FIG. 1 are indicated by the same reference numbers, and will not be described in detail. In the embodiment illustrated in FIG. 3, rather than use a separate hydraulic circuit to power the intensifier cylinder 102, fuel from the fuel supply 118 is pre-pressurized, in a known manner by a pre-pressure stage 302 to a first high pressure, such as, for example, the 2,000 to 4,000 psi of a typical hydraulic system. The pre-pressurized fuel is then employed to drive the intensifier piston, in a manner similar to that described with reference to the embodiment of FIG. 1. Instead of venting hydraulic fluid to a sump 116, as described above, fuel vented from the upper and lower control chambers 126, 128 while driving the piston 104 is vented back to a fuel tank 304. A supply line 306 may be provided from the upper control chamber 126 to the intensifier chamber 120, as shown in FIG. 3, or from some other portion of the fuel supply system, to provide fuel to the intensifier chamber 120. An advantage of the embodiment of FIG. 3 is that a separate hydraulic fluid system is not required, which simplifies the plumbing requirements, and reduces the overall complexity of the system 300.

The switching control unit may be a discrete device, or may be a part of another control unit. It may also be comprised in an electronic control unit of the engine or vehicle, as software or dedicated circuitry.

Figure 4:
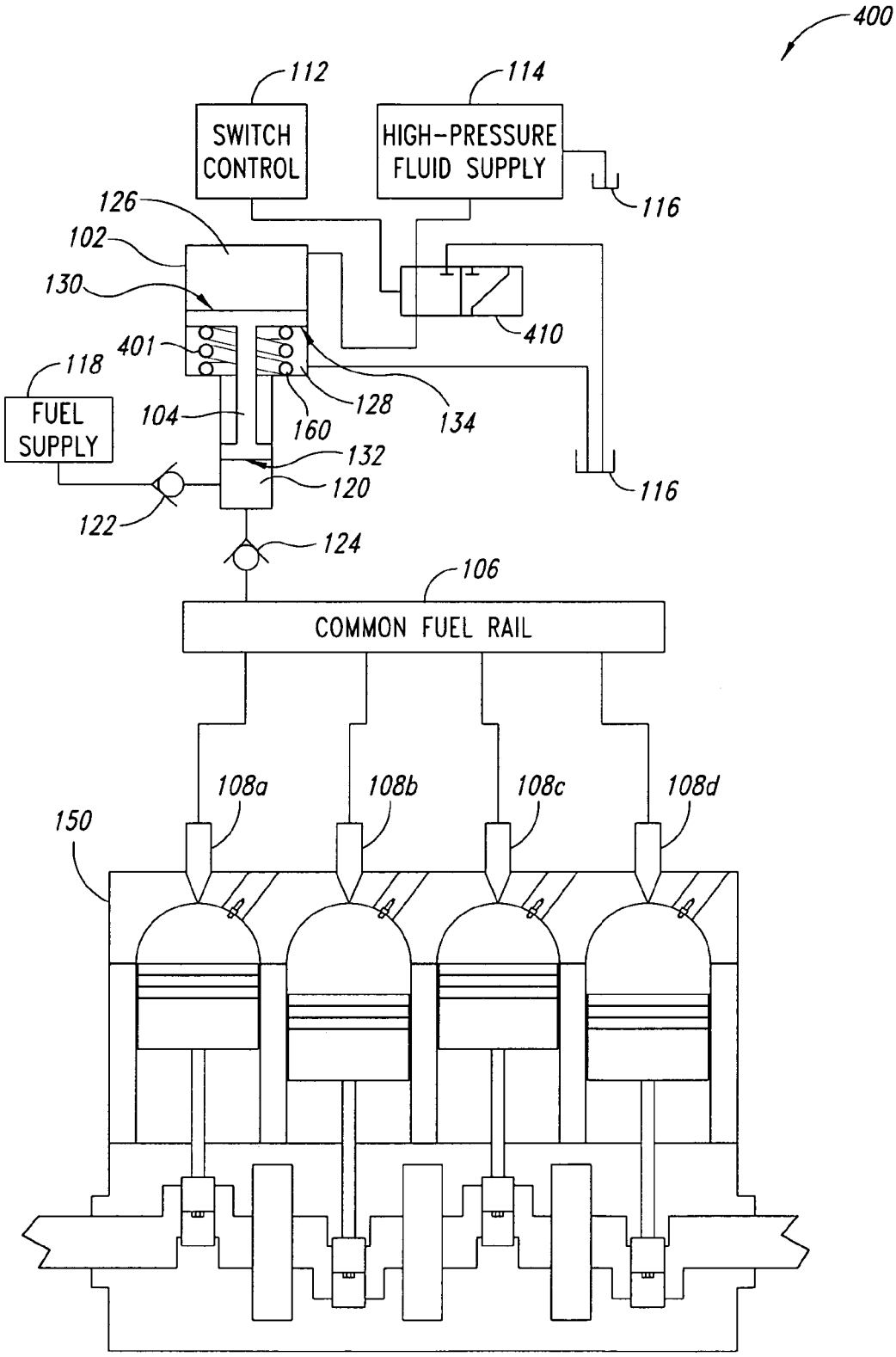
FIG. 4 shows a fuel injection system for an internal combustion engine, according to a further embodiment of the invention.

Referring now to FIG. 4, an additional embodiment of the invention is illustrated, in which a system 400 is shown. Features of the system 400 that are substantially the same as those of the system 100 of FIG. 1 are indicated by the same reference numbers, and will not be described in detail. In the embodiment illustrated in FIG. 4, a mechanical spring 401 is provided in the lower control chamber 128, which provides upward force on the lower piston surface 134. This eliminates the need for high-pressure fluid in the lower control chamber 128. Accordingly, valve 410 is simplified, in comparison to valve 110 of FIG. 1. Only the pressure in the upper chamber 126 is switched between high- and low-pressure fluid sources, while fluid in the lower chamber 128 remains at the low fluid pressure of the sump 116.

When valve 410 places the high-pressure fluid source 114 in fluid communication with the upper chamber 126, the force exerted by the high-pressure fluid on the upper piston surface 130 overcomes the upward biasing force of the spring 401, driving the piston 104 downward and pressurizing the fuel in the intensifier chamber 120. When valve 410 vents the upper chamber 126 to the sump, the biasing force of the spring 401 drives the piston 104 upward, recharging the intensifier chamber 120.

In addition to the simplified valve arrangement, the intensifier piston of system 400 consumes less high pressure fluid than the system 100 illustrated in FIG. 1. While pressurizing the hydraulic fluid of the high-pressure fluid supply is not as energy-expensive as pressurizing an equal volume of pressurized fuel, there is still a cost, ultimately expressed in fuel efficiency of the associated engine system.

Control of the injection events of the injectors is done in accordance with known control methods, such as, for example, hydraulic valve switching, fuel valve switching, piezoelectric switching, etc. Exemplary control systems for injectors are disclosed in the following U.S. Pat. Nos. 5,979,803; 6,568,368; and 6,622,702, each of which is hereby incorporated by reference, in its entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

The invention claimed is:

1. A fuel injection supply system, comprising:

an intensifier cylinder having an intensifier piston configured to pressurize fuel in an intensifier chamber of the cylinder during a pressurizing stroke, and further configured to draw fuel into the intensifier chamber during a recharge stroke;

a fuel rail in fluid communication with the intensifier chamber and configured to provide pressurized fuel to a plurality of fuel injectors; and a control unit configured to control switching of the intensifier piston between a pressurizing stroke and a recharge stroke, in which the control unit controls recharge strokes of the piston to occur only between an end of one injection event and a beginning of a consecutive injection event of the plurality of fuel injectors.

2. The system of claim 1 wherein the intensifier piston is configured to be hydraulically locked except during injection events of any of the plurality of fuel injectors, or during a recharge stroke of the piston.

3. The system of claim 1 wherein the control unit is configured to control switching of the intensifier piston to perform a recharge stroke once during each cycle of an engine associated with the fuel injection system.

4. The system of claim 1 wherein the control unit is configured to control switching of the intensifier piston to perform a recharge stroke more than once during each cycle of an engine associated with the fuel injection system.

5. The system of claim 1, further comprising an additional intensifier cylinder, fluidically isolated from the common fuel rail and in fluid communication with an additional common fuel rail configured to provide pressurized fuel to an additional plurality of fuel injectors.

6. The system of claim 1 wherein the intensifier cylinder is powered by a hydraulic fluid circuit.

7. The system of claim 6, further comprising a switching valve, and wherein the control unit is configured to control switching of the intensifier piston by controlling the switching valve.

8. The system of claim 6 wherein the hydraulic fluid circuit employs pre-pressurized fuel as hydraulic fluid in the circuit.

9. An engine system, comprising:

an internal combustion engine having a plurality of cylinders;

a plurality of fuel injectors, positioned to inject pressurized fuel into each of the plurality of cylinders;

a common fuel rail in fluid communication with each of the plurality of injectors;

an intensifier cylinder having an intensifier piston configured to pressurize fuel in an intensifier chamber of the cylinder during a pressurizing stroke and to draw fuel into the intensifier chamber during a recharge stroke, the intensifier chamber being in fluid communication with the common fuel rail; and a control unit configured to control switching of the intensifier piston between a pressurizing stroke and a recharge stroke of the piston, the control unit adapted to control recharge strokes of the piston to occur between two consecutive injection events of the plurality of fuel injectors, the intensifier piston being configured to be hydraulically locked except during injection events of any of the plurality of fuel injectors, or during a recharge stroke of the piston.

10. The engine system of claim 9, further comprising a hydraulic circuit configured to power the intensifier cylinder.

11. The engine system of claim 9, further comprising:

an additional plurality of fuel injectors;

an additional common fuel rail in fluid communication with each of the additional plurality of injectors; and an additional intensifier cylinder having an intensifier chamber in fluid communication with the additional common fuel rail.

12. The system of claim 1 wherein the control unit is configured to control switching of the intensifier piston to a recharge stroke more than once during each cycle of an engine associated with the fuel injection system.

13. A method comprising:

applying pressure to an upper first surface of a piston in an intensifier cylinder to pressurize fuel in an intensifier chamber of the intensifier cylinder;

supplying the pressurized fuel to a plurality of fuel injectors;

firing one of the plurality of injectors, including opening the one injector to allow fuel to flow from the one injector and closing the one injector to stop the flow of fuel;

firing a next of the plurality of injectors after the one injector in a firing sequence of the plurality of injectors, including opening the next injector to allow fuel to flow from the next injector and closing the next injector to stop the flow of fuel; and recharging fuel in the intensifier chamber, including beginning the recharging after the closing the one injector and ending the recharging before the opening the next injector.

14. The method of claim 13, further comprising hydraulically locking the piston except while an injection event is occurring, or during the recharging fuel step.

15. The method of claim 13, further comprising pre-pressurizing fuel, wherein the applying pressure step includes providing pre-pressurized fuel to the first surface of the piston.

16. A system comprising:

pressurizing means for pressurizing fuel in an intensifier chamber of a cylinder during a pressurization stroke;

transmitting means for transmitting the pressurized fuel to a plurality of fuel injectors; and recharging means for recharging the pressurizing means only between an end of one injection event and a beginning of a consecutive injection event of the plurality of fuel injectors.

17. The system of claim 16, further comprising means for hydraulically locking the pressurizing means except during injection events, or during recharging of the pressurizing means.

18. A fuel injection supply system, comprising:

a single-intensifier fuel rail configured to operate without a secondary source of pressurized fuel, adapted to provide pressurized fuel to a plurality of fuel injectors, and in which an intensifier piston of the intensifier is configured to be hydraulically locked except during injection events of any of the plurality of fuel injectors, or during a recharge stroke of the piston; and a control unit configured to control switching of the intensifier piston between pressurizing strokes and recharge strokes, the control unit adapted to control recharge strokes of the piston to occur between an end of one injection event and a beginning of a consecutive injection event of the plurality of fuel injectors.

19. The system of claim 18 wherein the control unit is configured to control switching of the intensifier piston to perform a recharge stroke once during each cycle of an engine associated with the fuel injection system.

* * * * *